US005125447A

United States Patent [19]

Suggs

[11] Patent Number: 5,125,447

[45] Date of Patent: Jun. 30, 1992

[54] SAFETY DEVICE FOR WINDOW DECORATION CORDS

[76] Inventor: Timothy Suggs, 3951 SW. 130 Ave., Miramar, Fla. 33027

[21] Appl. No.: 650,091

[22] Filed: Feb. 4, 1991

[51] Int. Cl.[5] ..... A47H 5/00

[52] U.S. Cl. ..... 160/344; 160/320

[58] Field of Search ..... 160/321, 322, 320, 331, 160/344, 345, 168.1, 176.1, 178.1, 173, 177, 166.1, 107

[56] References Cited

U.S. PATENT DOCUMENTS

| | | | |
|---|---|---|---|
| 2,788,481 | 4/1957 | Lui et al. | 160/331 X |
| 3,022,819 | 2/1962 | Lampret | 160/345 |
| 3,096,078 | 7/1963 | Steingass et al. | 160/331 X |
| 3,117,767 | 1/1964 | McLean et al. | 160/331 X |
| 3,478,807 | 11/1969 | Hertzberg | 160/344 |
| 4,807,683 | 2/1989 | Hennequin et al. | 160/173 |

*Primary Examiner*—David M. Purol

*Attorney, Agent, or Firm*—Malloy, Downey & Malloy

[57] ABSTRACT

A safety device to house a window decoration cords which includes a tunnel defining structure to be affixed adjacent a building opening and in which the cords for manipulating window decorations are housed and which tunnel defining structure includes a slot through which an operator extends to grip a portion of a cord so that a portion extending exteriorly through the slot may be slidably moved to manipulate the cords to move the window decorations accordingly.

6 Claims, 1 Drawing Sheet

SAFETY DEVICE FOR WINDOW DECORATION CORDS

This invention is of a safety device to house window decoration cords, and more particularly to an elongate safety tunnel means to be affixed to a building wall to house cord means depending from a window decoration adjacent a building opening.

BACKGROUND OF THE INVENTION

Generally, a window or door in a building, albeit necessary, is architecturally unpleasing. For this reason, openings, such as windows and patio doors, are provided with decorations, such as blinds, curtains, draperies, etc. to "dress up" the otherwise unappealing opening. Such decorations, usually include a guide track with sliders in the guide track and connected to the curtain, drapery, or the like so that the window decoration can be manipulated when the sliders are moved along the track to control light or air, when a window spanning the opening is opened, entering into the building. To manipulate the wall decorations and move them slidably, ordinarily cords are provided which depend from the guide track, usually at one side of the building opening. Such cords, dangling from the track present a hazard to young children. There have been numerous cases reported where children have become entangled in the cords and injured severely or even killed.

This invention is of a tunnel means which defines a housing extending vertically along the wall adjacent the building opening, is fastened to it, and within which the cords depend vertically so that children cannot get entangled in the cords. Preferably, the structure includes tunnel means with an operator means extending through an elongate slot in the tunnel means which grips the cord means within the tunnel means and which has a portion exteriorly accessible for sliding movement of the operator means along the slot in the tunnel means while gripping the cord means so that the window decoration can be manipulated.

OBJECT OF THE INVENTION

It is, accordingly, an object of this invention to provide an inexpensive tunnel safety cover to enshroud the cord means for manipulating a window decoration to protect children from becoming entangled in the cords and which, nevertheless, permits manipulation of the window decorations upon movement of the cord means using the operator means.

It is a general object of this invention to provide a safety device for housing the cords of a window opening decoration.

DESCRIPTION OF THE PREFERRED EMBODIMENT

Figure 1:
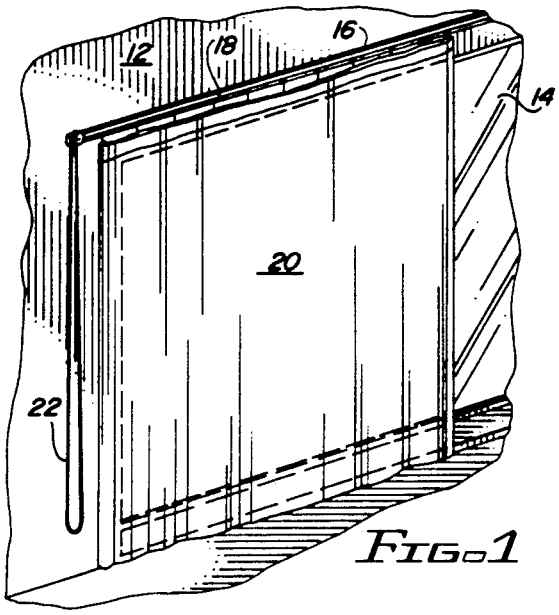
FIG. 1 is a vertical view of a building wall with an opening, such as a window opening, and illustrating a curtain attached to a guide track with a depending cord for manipulating the curtain.

Referring to the drawings, there is shown a building wall generally designed by the numeral 12 with an opening 14 in it. Above this opening, there is a slide track 16 with slides such as 18 captivated for sliding movement along the track 16 and engaging a curtain 20 which can be manipulated using a cord 22 at the side of the opening to move the slides. This is a conventional structure. The cord is moved opening or closing the curtain. In practical effect, the dangling cord 22 is dangerous to small children since they can become entangled in it and become severely injured or killed.

Figure 4:
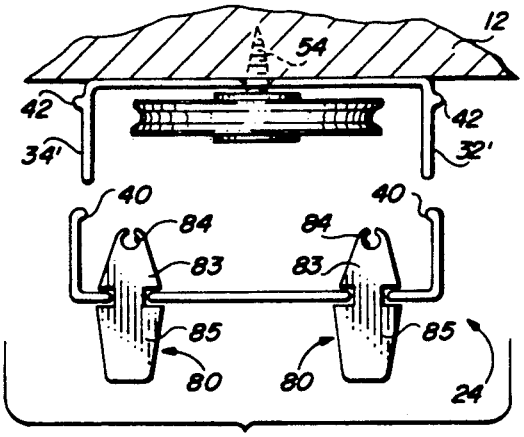
FIG. 4 is a top view of the tunnel means in exploded relation and illustrating the arrangement of the parts.
Figure 2:
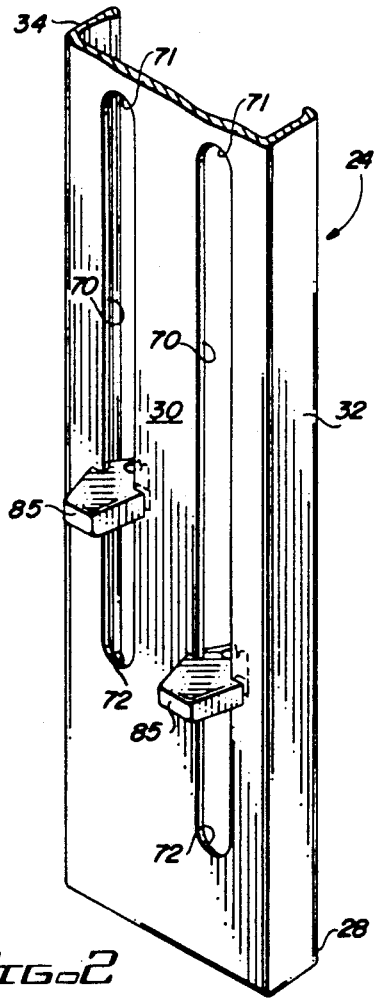
FIG. 2 is a perspective view of the lower end zone of a tunnel means according to this invention which has been broken away.
Figure 3:
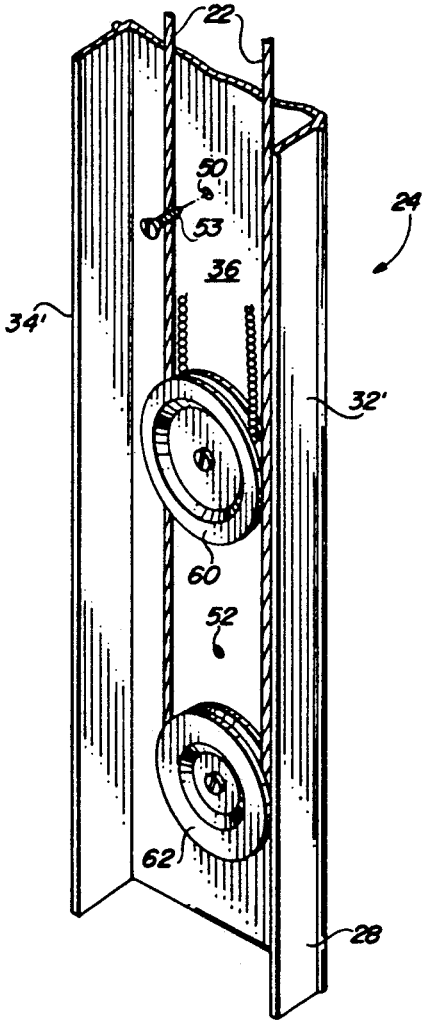
FIG. 3 is a view similar to FIG. 2 of a mating portion of the tunnel means for mating hooked up engagement with that portion of the tunnel means shown in FIG. 2.

The invention shown in FIGS. 2, 3 and 4 is of an elongate tunnel means 24 which has an upper end 26, see FIG. 1, and a lower end 28, see FIGS. 2 and 3. The tunnel means, which has been broken away in FIGS. 2 and 3, is positioned vertically on the wall 12 adjacent the window opening and houses the cords 22 in depending relation within it. In a preferred embodiment, the tunnel means includes an outer surface 30 opposed side surfaces 32 and 34, and an inner surface 36. The inner surface 36 and the outer surface 30, may be include companionate side portions including the side surfaces 32 and 34' on the inner surface which are provided with means, see FIG. 4, such as 40 and 42 which are adapted for hooked up relation when the outer surface is pressed toward the inner surface so that the portions 40 and 42 flair outwardly as guided by the terminal surface and the shoulders hook up with the barbs 42 on the inner surface sides 34' and 32'. Through the inner surface, there are holes such as 50 and 52 so that a screw such as 54 may be utilized to attach the tunnel means to the wall surface in a vertical orientation adjacent the building opening to accommodate the cords, as seen in FIG. 3.

When the tunnel means are arranged, by first securing the inner surface to the wall and before interconnecting the interlocking of the side surface portions, the cord means 22 is arranged within the tunnel means. In a preferred embodiment, a rotatable pulley 60 is secured adjacent the lower end 28 to maintain the cord taut and the cord is received on the pulley. There may be several pulleys, such as 60 and 62, which constrained the cords to movement about the pulley.

For manipulating the cords, see FIG. 2, the outer surface 30 is provided with longitudinally extending slot means 70 which have upper ends such as 71 and lower ends such as 72. Within these slot means, there are provided cord operator means 80, see FIG. 4. In the preferred embodiment, these operator means include an inner portion 83 which has a bifurcated cord gripping portion 84, defining lips and a mouth and an outer portion 85 which extends through the slot. In use, the cord is inserted through the lips and into the mouth which comprises gripping means 84. The lips open slightly being of resilient plastic material with a memory to permit the entrance of the cords into the mouth which is sized to grip the cord at a point along its length. Thereafter, when the exterior portion or operator portion 85 is slidably moved vertically along the slot, the cord is moved simultaneously by reason of being gripped. In this manner, the window decoration is manipulated in the conventional manner albeit the cord is housed within the tunnel means.

While this invention has been shown and described and what is considered to be a practical and preferred embodiment, it is recognized that departures can be made within the spirit and scope of this invention which should, therefore, not be limited except as set forth in the claims hereinafter and in accordance with the doctrine of equivalents.

What is claimed is:

1. For vertical installation adjacent one side of an opening in a building having an inside surface and a floor, wherein the opening is spanned by a window decoration support rod at a predetermined height above a floor with depending cords to manipulate a window decoration, a safety device to guard against entanglement of children by the cords, said device comprising:

an elongate tunnel means having an open upper end and a lower end, said tunnel means being of a length less than the predetermined height of said support rod above the floor and with said open upper end in spaced relation from the support rod and with said lower end spaced from said upper end a distance greater than the cord means depending from the rod, said tunnel means having an outer surface, opposed side surfaces, and an inner surface, said inner surface being spaced and oppositely disposed from the outer surface and extending away from the side surfaces, means to secure the inner surface of said tunnel means to the inside surface of the building above the floor and below the opening and adjacent the building opening with the tunnel means in a vertical orientation, said tunnel means and said open end of said tunnel means being sized to receive the cords in depending longitudinal relationship within the tunnel means, an elongate, longitudinally extending slot means in the outer surface spaced from said open top end, movable means in the slot means including an inner portion in the tunnel means and an outer portion exterior of the tunnel means, said movable means being configured for and movably captivated between said portions by said outer surface and constrained to longitudinal movement along the slot, said inner portion including gripping means to engage the cord means for manipulating the window decoration when the cord means are gripped by said inner portion gripping means and said movable means are moved along the slot of said tunnel means.

2. The safety device including said elongate tunnel means as set forth in claim 1 wherein means to maintain the cord means taut are provided in the tunnel means.

3. The safety device as set forth in claim 1, in combination, wherein said means to maintain the cord means taut comprise a pulley fixed to the tunnel means adjacent said lower end with said slot means being intermediate said upper end and said means to maintain the cords taut and with said cord means including a portion engaging said pulley means.

4. The safety device including said tunnel means as set forth in claim 1 wherein said tunnel means includes a decorative exterior surface.

5. The safety device as set forth in claim 1 including said tunnel means wherein said gripping means comprises said inner portion being bifurcated including open lips and a mouth and said cord is sized relative to said lips and mouth to be forcibly inserted into said mouth into snug gripping relation.

6. For vertical installation adjacent one side of an opening in a building having an inside surface and a floor, wherein the opening is spanned by a window decoration support rod at a predetermined height above a floor with depending cords to manipulate a window decoration, a safety device to guard against entanglement of children by the cords, said device comprising:

an elongate tunnel means having an open upper end and a lower end, said tunnel means being of a length less than the predetermined height of said support rod above the floor and with the open upper end in spaced relation from the support rod and with said lower end spaced from said upper end a distance greater than the length of the cord means depending from the rod, said tunnel means having an outer surface, opposed side surface, and an inner surface, said inner surface being spaced and oppositely disposed from the outer surface and extending away from the side surfaces, means to secure the inner surface of said tunnel means to the inside surface of the building above the floor and below the opening and adjacent the building opening with the tunnel means in a vertical orientation, said tunnel means and said open end of said tunnel means being sized to receive the cords in depending longitudinal relationship within the tunnel means, an elongate, longitudinally extending slot means in the outer surface spaced from said open top end, movable means in the slot means including an inner portion in the tunnel means and an outer portion exterior of the tunnel means, said movable means being configured for and movably captivated between said portions by said outer surface and constrained to longitudinal movement along the slot, said inner portion including gripping means to engage the cord means for manipulating the window decoration when the cord means are gripped by said inner portion gripping means and said movable means are moved along the slot of said tunnel means, said safety device including tunnel means wherein a) said inner surface includes side surface portions and b) said outer surface includes side surface portions sized and configured to mate with said inner surface side surface portion to form said side surfaces, and means provided to interconnect said a) inner surface and b) said outer surface and c) said side surface portions, to define said tunnel means when interconnected.

* * * * *